US009468270B2

(12) United States Patent
Malamphy

(10) Patent No.: US 9,468,270 B2
(45) Date of Patent: Oct. 18, 2016

(54) BODY JEWELRY AND METHOD OF USING SAME

(76) Inventor: Wendy R. Malamphy, Mechanicsville, VA (US)

( * ) Notice: Subject to any disclaimer, the term of this patent is extended or adjusted under 35 U.S.C. 154(b) by 570 days.

(21) Appl. No.: 13/541,736

(22) Filed: Jul. 4, 2012

(65) Prior Publication Data

US 2013/0305781 A1 Nov. 21, 2013

Related U.S. Application Data

(60) Provisional application No. 61/504,610, filed on Jul. 5, 2011.

(51) Int. Cl.

| | |
|---|---|
| ***A44C 15/00*** | (2006.01) |
| ***A44C 5/00*** | (2006.01) |
| ***A44C 27/00*** | (2006.01) |

(52) U.S. Cl.

CPC ..... *A44C 15/0075* (2013.01); *A44C 5/0053* (2013.01); *A44C 27/00* (2013.01); *Y10T 29/49591* (2015.01)

(58) Field of Classification Search

CPC ..... A44C 5/0053; A44C 15/0045; A44C 15/0075; A44C 15/0085; A44C 15/009; A44C 19/00; A45D 2008/004; A45D 2008/006; A45D 8/34

USPC ..... 368/282; 63/21, 23, 11; D10/32; 224/170; 132/273, 275; 24/300, 115 H

See application file for complete search history.

(56) References Cited

U.S. PATENT DOCUMENTS

| | | | | | |
|---|---|---|---|---|---|
| 1,628,278 | A | * | 5/1927 | Scheuer | 63/3.1 |
| 1,691,445 | A | * | 11/1928 | Meliodon | 63/1.18 |
| D110,166 | S | * | 6/1938 | Arzt | D10/33 |
| 2,608,691 | A | * | 9/1952 | Berg | A41F 17/00 2/325 |
| 3,656,244 | A | * | 4/1972 | Andrade | 36/1 |
| 3,751,769 | A | * | 8/1973 | Reiner | A45D 8/34 132/273 |
| 4,293,601 | A | * | 10/1981 | Cole | A41G 1/00 229/125.38 |
| 4,757,558 | A | | 7/1988 | Strongwater | |
| D300,881 | S | * | 5/1989 | Dickenson | D2/896 |
| 4,827,738 | A | | 5/1989 | Rothal | |
| 4,936,699 | A | * | 6/1990 | Yoshida | 401/48 |
| 5,363,675 | A | | 11/1994 | Carter | |
| 5,386,710 | A | | 2/1995 | Moore | |
| 5,526,654 | A | | 6/1996 | Carter | |
| 5,779,113 | A | * | 7/1998 | Huang | 224/172 |
| D432,760 | S | | 10/2000 | Brachfeld | |
| D438,483 | S | * | 3/2001 | Mesica | D11/3 |
| 6,513,685 | B1 | * | 2/2003 | Tzoubris | 223/111 |
| 6,519,207 | B1 | * | 2/2003 | Lukacsko | 368/10 |
| 2004/0206115 | A1 | * | 10/2004 | Hara | 63/15.1 |
| 2006/0005575 | A1 | | 1/2006 | LaRocca | |
| 2006/0144083 | A1 | * | 7/2006 | Layton | 63/3.1 |
| 2007/0062217 | A1 | | 3/2007 | Graham | |
| 2011/0314866 | A1 | * | 12/2011 | Niikura | 63/3.2 |

FOREIGN PATENT DOCUMENTS

| | | | |
|---|---|---|---|
| FR | 618601 | A * | 3/1927 |
| FR | 783202 | A * | 7/1935 |
| FR | 1338217 | A * | 9/1963 |
| FR | 1431082 | A * | 3/1966 |
| JP | 3385356 | B2 * | 3/2003 |

* cited by examiner

*Primary Examiner* — Abigail Morrell

(74) *Attorney, Agent, or Firm* — Allen IP Law PLC; Leslie C. Allen, Esq.

(57) ABSTRACT

Referring to the invention, there is shown an article of body jewelry intended to be worn upon the hand. The body jewelry comprises a length of an elastic material upon which may be threaded one or more decorative elements and an ornamental decoration. A portion of the elastic material is connected to a securement element. The body jewelry is secured to multiple parts of the hand, using the tension within the elastic material stretched between various locations; e.g., from the back of the wrist, over the back of the hand, to a securement element sitting behind two adjacent fingers.

4 Claims, 10 Drawing Sheets

BODY JEWELRY AND METHOD OF USING SAME

CROSS-REFERENCE TO RELATED APPLICATIONS

This application is based on provisional application No. 61/504,610, filed on Jul. 5, 2011, priority of which is hereby claimed.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention is in the technical field of JEWELRY.

More particularly, the present invention is in the technical field of BODY JEWELRY. More particularly, the present invention relates to JEWELRY WORN ON PARTS OF THE BODY, SUCH AS THE HAND, and a method of making and attaching the jewelry to the body.

Historically, an issue with jewelry worn on a body part has been the method of attachment of the jewelry to the body. Traditional methods include encircling the body part with the jewelry (e.g., a chain), and attaching two ends of the jewelry with a clasp or some other attaching means. Other methods of attachment have included using molded wire or other pliable material, to mold to a body pan. These methods provide disadvantages, including difficulty of attachment, discomfort to the wearer, inadequate staying ability, non-flexibility, and difficulty of detachment.

For example, one traditional method of attachment of body jewelry has been to encircle the body part with the jewelry and attach the two ends with a traditional clasp or similar means see, for example, U.S. Pat. App. No. 2006/0005575 A1 to LaRocca, and U.S. Pat. App. No. 2007/0062217 A1 to Graham), U.S. Pat. App. No. 2006/0005575 A1 discusses clasps as providing an opening and closing of a chain around a body part. Similarly, U.S. Pat. App. No. 2007/0062217 describes an instep bracelet that is connected by a clasp. In each of the cases above, a piece of material "encircles," or forms a circle around a body pan and is connected with a clasp to hold the jewelry in place.

Other body jewelry patents appear to describe variations from simply "encircling" a single body part (see U.S. Pat. No. 6,523,685, Des. 5,386,710, 5,526,654, and Des, 423, 760). However, these patents simply employ two err more body part encircling elements into their design, along with an attaching means between the two encircling elements.

For example, U.S. Pat. No. 6,513,685 to Tzoubris describes a ring securing device. An elongated loop serves as an "attaching means" to hold a ring in place, by connecting the ring to a wristband. Therefore, this design simply incorporates two body part encircling elements, a ring and wristband, and an attaching means, a loop, to hold the jewelry in place.

Des. 5,386,710 describes an article of foot jewelry comprising a closed toe loop, a connecting bridge, and a closed ankle loop. When applied to the foot, the connecting bridge stretches across the wearer's instep and attaches the toe loop to the ankle loop. Thus, two body part encircling elements, the two loops, are connected via an attaching means, the connecting bridge.

U.S. Pat. No. 5,526,654 describes a body decoration worn on the back of the hand. The body decoration is made up of an ornamental element connected to a flexible pliable wire. One end of the wire is wrapped around die wearer's wrist, and the other is wrapped around the wearer's finger. The ornamental element stays in place on the back of the hand, along a portion of wire that serves as an attaching means between one body pan encircling element, a ring, and a second body part encircling element, a wrist bracelet.

Des, 432,760 describes an ornamental design for a "ring connected ankle to toe or wrist to finger bracelet." In this patent, one body part encircling element, a ring, is connected via an attaching means, a chain, to another body part encircling element, a bracelet.

Though each of the four patents above are distinct, the general idea of employing two body part encircling elements to hold a body decoration in place, with help of an attaching means, is apparent in all font. Therefore, like the traditional bracelet or ring patents and applications, these four patents describe jewelry held in place through the use of an encircling element that literally forms a "circle" around a body pan.

Though some patents do appear to suggest an alternate method of body jewelry attachment, apart from literally "encircling" a body part, they are few.

One such patent is U.S. Pat. No. 4,827,738, to Rothel. This patent describes attaching ear ornamentation to the ear using a formed wire. The formed wire is molded to the bank of the ear and connects to two compression coils, each located at either end of the formed wire. The invention therefore molds to, rather than encircles the ear. Other methods of jewelry attachment, that do not require "encircling" a body element, are difficult to find.

Presently there is a need in the field of body jewelry to employ new methods of securing body jewelry to one or more body parts, apart from simply "encircling" or "molding" an element of body jewelry around one or more body parts.

SUMMARY OF THE INVENTION

The present invention relates to a new form of body jewelry, and a method of attaching it to more than one body pan location. The body jewelry incorporates at least one ornamental decoration held in place along a section of elastic material. The body jewelry is secured to more than one body part location by placing a first section of the body jewelry around a first location of the body, stretching a second section of the body jewelry over a second location of the body, and securing a third section of the body jewelry behind a third location of the body, using a securement element. The body jewelry does not simply "encircle" a body part. The body jewelry stays in place by using the tension created within the body jewelry as it is pulled between multiple body locations and secured.

The body jewelry is easy to apply, and is comfortable to wear for long periods. It is fashionable as well as practical for all ages. It stays in place without the need for a traditional hook or loop clasp. It is not designed to look like a ring or bracelet; rather, it has a unique design not previously seen in body jewelry. It offers several advantages over the prior art;

namely, ease of application, tension-based securement, superior staying ability, secure fit, wearer comfort, and innovative design.

DETAILED DESCRIPTION OF THE INVENTION

Figure 1:
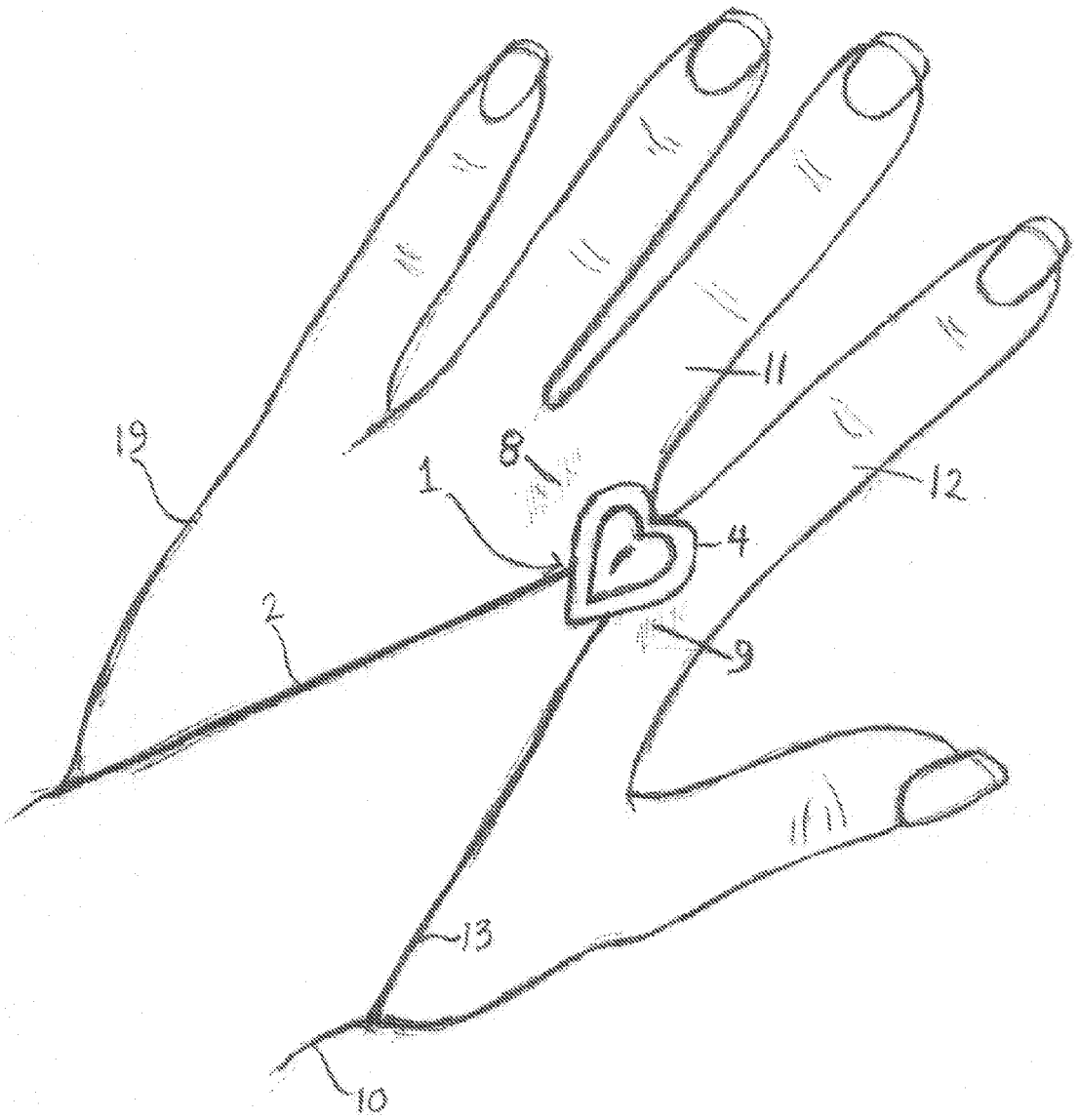
FIG. 1 is a front elevational view of an article of body jewelry constructed in accordance with one exemplary embodiment of the present invention, and applied, in its expanded state to the bare hand of the wearer.
Figure 2:
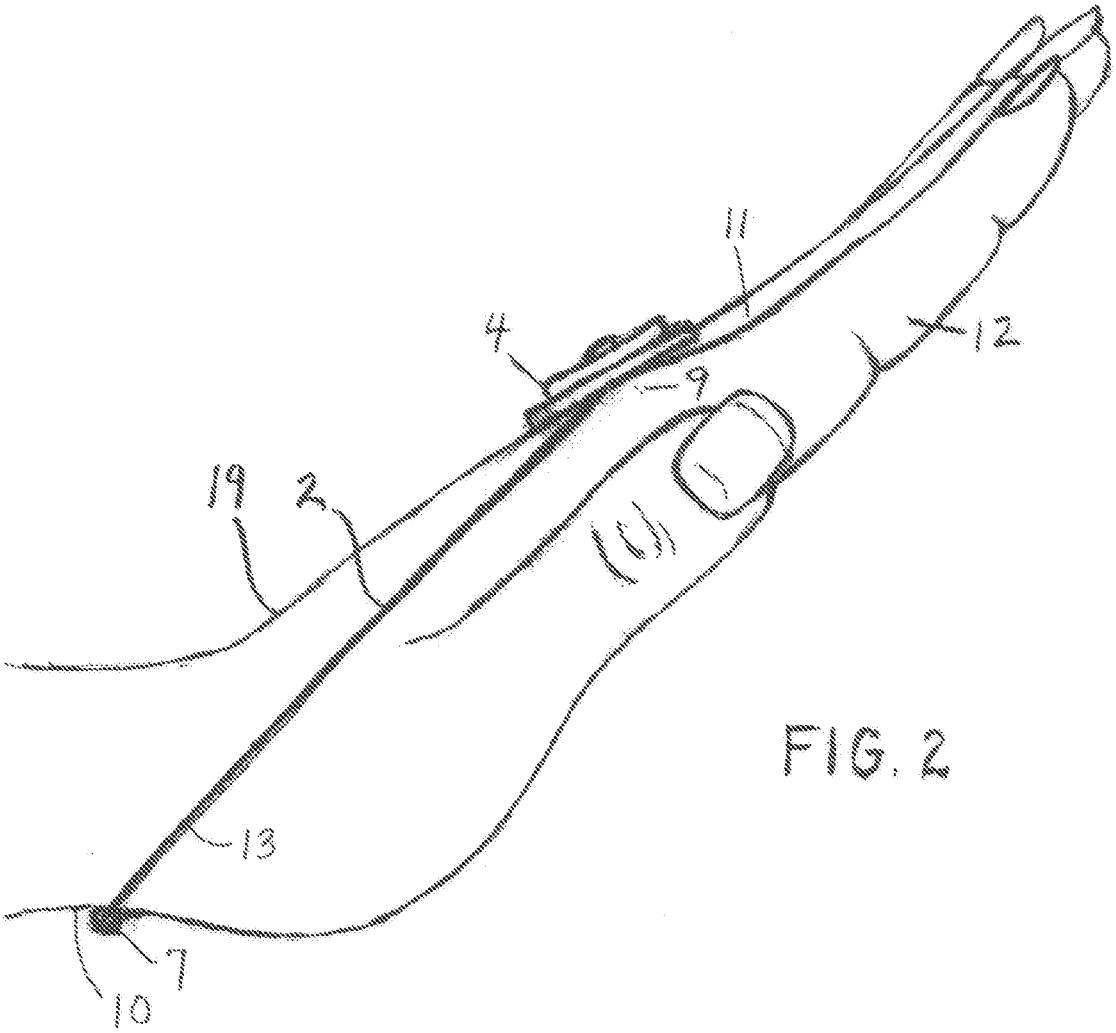
FIG. 2 is a side view of a the body jewelry of FIG. 1, as applied in its expanded state to the hare hand of the wearer.
Figure 3:
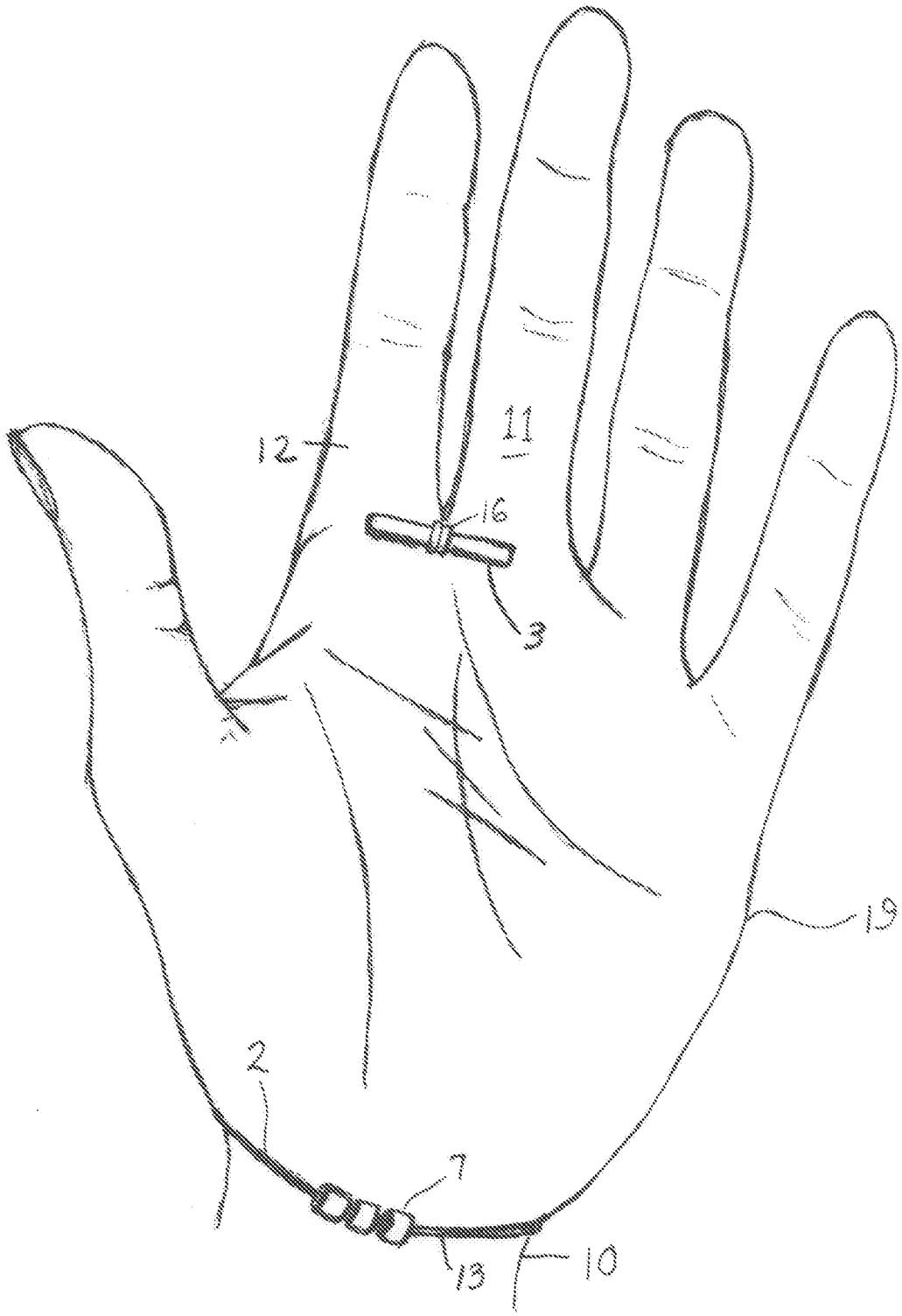
FIG. 3 is a back elevational view of the body jewelry of FIG. 1, as applied in its expanded state to the bare hand of the wearer.

Referring now to the invention in more detail, in FIG. 1 to FIG. 5 there is shown an article of body jewelry 1 intended to be worn upon the hand 19. The body jewelry 1 comprises a length of an elastic material 2, upon which may be threaded one or more decorative elements 7 and one or more ornamental decoration(s) 4. A portion of the elastic material 2 is connected to a securement element 3. The body jewelry 1 is secured to multiple parts of the hand 19, using the tension within the elastic material 2 stretched between various locations; e.g., from the back of the wrist 10, over the back of the hand 19, to securement element 3 sitting behind adjacent fingers 11 and 12.

Referring to FIG. 1 to FIG. 5, in operation, section 13 of the elastic material 2 located between an ornamental decoration 4 and the one or more decorative elements 7 is placed around the wrist 10 of the wearer. The ornamental decoration 4 is then positioned on the back of the hand 19, e.g., between knuckles 8 and 9 of the back of the hand 19, by stretching the securement element 3 and ornamental decoration 4 attached to the elastic material 2 over the back, of the hand 19 and placing the securement element 3 behind two adjacent fingers, e.g., fingers 11 and 12 of the hand 19. A first section of the elastic material 2 remains secure at the back of the wrist 10, the ornamental decoration. 4 attached to elastic material 2 remains secure over the knuckles 8 and 9, and the securement element 3 attached to elastic material 2 remains in place behind fingers 11 and 12.

Figure 4:
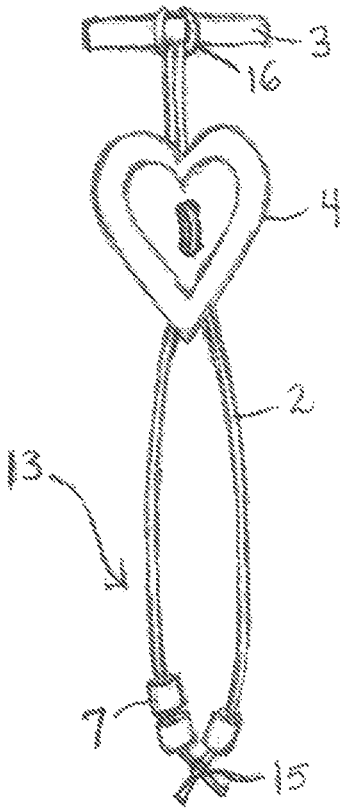
FIG. 4 is a front elevational view of the body jewelry of FIG. 1, the body jewelry shown, in an unexpanded state when it is not applied to the wearer's hand.
Figure 5:
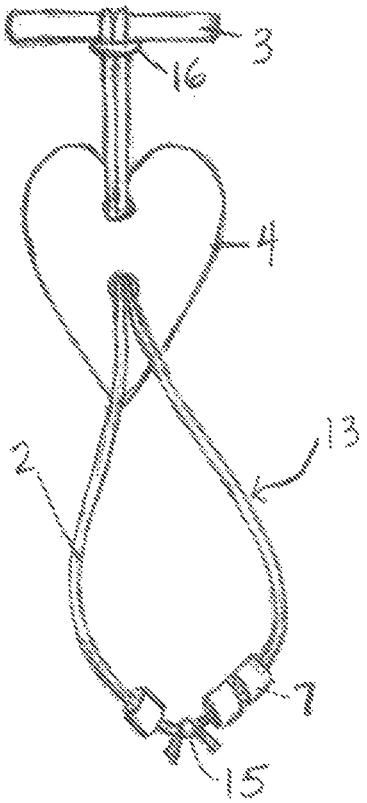
FIG. 5 is a back elevational view of the body jewelry of FIG. 1, the body jewelry shown in an unexpanded state when it is not applied, to the wearer's hand.
Figure 6:
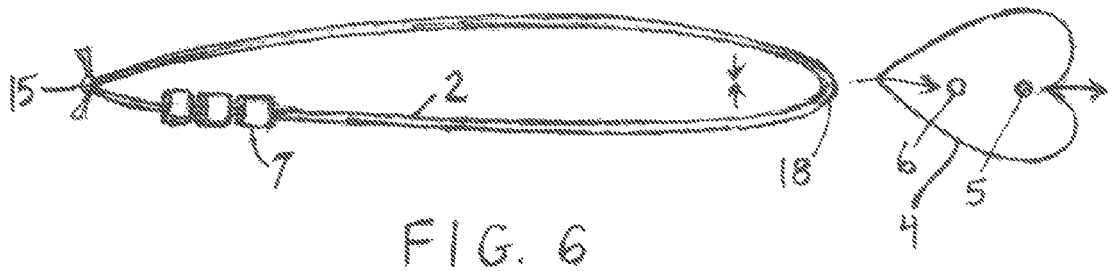
FIG. 6 is a back elevational view of the body jewelry of FIG. 1, the body jewelry shown in an unexpanded state in its first phase of construction.

In further detail, still referring to the invention of FIG. 1 to FIG. 5, the elastic material 2 is sufficiently thick for threading decorative elements, such as about 0.50 mm to 2.0 mm in diameter (thickness). The length of the elastic material 2 must be adjusted to produce enough tension to maintain the ornamental decoration 4 in place, but must remain slack enough to be comfortable to the wearer, depending on the size of the wearer's hand 19. This effect should be reached when the length of the body jewelry is between about 3 inches and 6 inches, when the body jewelry 1 is laid flat and measured, irons top of securement element 3 to knot 15, as depicted in FIG. 4.

In further detail, stilt referring to the invention of FIG. 1 to FIG. 5, the securement element 3 should be sufficiently long enough to stay in place between the two adjacent fingers 11 and 12, when, subjected to tension from the elastic material 2 located behind the wrist 10 and stretched over the back of the hand 19. The securement element 3 must also be thick enough to keen the ornamental decoration 4 in place by withstanding the tension within the elastic material 2, anchored behind the wearer's wrist 10, threaded through the ornamental decoration 4, and secured behind fingers 11 and 12 by the securement element 3. Thus, the securement element 3 should be about 0.75 inches to 1.25 inches long, and between, about 1.5 mm and 5 mm thick, depending on the density of the securement element 3 and the size of the wearer's hand 19.

In further detail, still referring to the invention of FIG. 1 to FIG. 5, when applied to the back of the band 19, the ornamental decoration 4 should be adjusted to sit between the left knuckle 8 and right knuckle 9, in front of the fingers 11 and 12. The securement element 3 sits behind two adjacent fingers 11 and 12. Thus, the ideal dimension of the ornamental decoration 4 is from about 30 inches to 2 inches in length across the top surface, and from about one-tenth of an inch to one inch in thickness.

The construction details of the invention as shown in FIG. 1 to FIG. 5 are that the ornamental decoration 4 be made of one or more of any series of decorations, including heads, pendants, wooden or plastic shapes, gemstones, crystals, metal, or any other decorative material, in addition, the decorative elements 7 can be made of beads, crystals, gemstones, metal bali heads, head caps, buttons, or any other decorative material. The elastic material 2 may be made of any variety of materials that are capable of being stretched or expanded, that resume their former shape when tension is released. The securement element 3 may be made of metal, compressed paper, wood, plastic, or any other material of sufficient strength and length to withstand tension and beep the ornamental decoration 4 on the wearer's hand 19. Further, the components of body jewelry 1 cam be made of different materials.

Now considering the method of making the invention as depicted in FIG. 1 to FIG. 5, see FIG. 6 to FIG. 9. In further detail, referring to FIG. 6, one end of a length, of elastic material 2 is threaded through a series of decorative elements 7, such that they remain on the elastic material 2. Next, the two ends of the elastic material 2 are tied to form a knot 15. Optionally, glue may be applied inside of one of the decorative elements 7, and that decorative element 7 may be secured over the knot 15 to hide the knot 15 from view.

Figure 7:
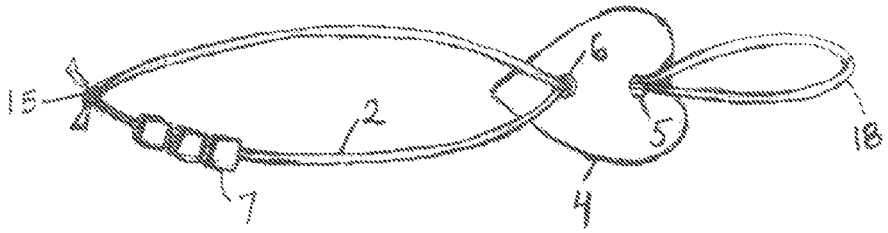
FIG. 7 is a back elevational view of the body jewelry of FIG. 1, the body jewelry shown in an unexpanded state in its second phase of construction.

In more detail, still referring to the invention of FIG. 6 to FIG. 9, in FIG. 7 the end of the elastic material 2 opposite the knot 15 is bent to form, a loop 18. The sides of loop 18 are pressed together and threaded through a first hole 6 of ornamental decoration 4, and hank through a second hole 5 of ornamental decoration 4.

Figure 8:
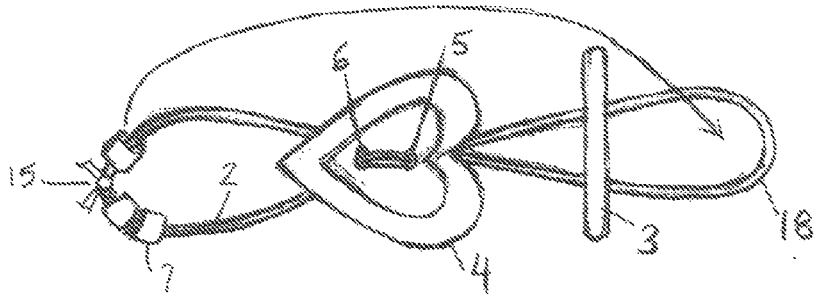
FIG. 8 is a front elevational view of the body jewelry of FIG. 1, the body jewelry shown in an unexpanded state in its third phase of construction.
Figure 9:
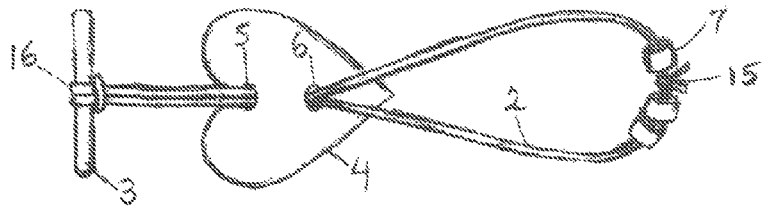
FIG. 9 is a back, elevational view of the body jewelry of FIG. 1, the body jewelry shown in an unexpanded state in its completed state of construction.

In more detail, still referring to the invention of FIG. 6 to FIG. 9, in FIG. 8 a securement element 3 is placed in front of the loop 15, to the right of the ornamental decoration 4. The ornamental decoration 4 and knot 15 at the bottom of the elastic material 2 are pushed through the loop 18, to the right of the securement element 3. The knot 15 is then pulled away from the securement element 3, to tighten the loop 18 around the securement element 3. The resulting knot 16 is shown in FIG. 9. Optionally, glue may be added to the reselling knot 16 on the securement element 3 to prevent loosening of the knot 16 from the securement element 3.

Figure 10:
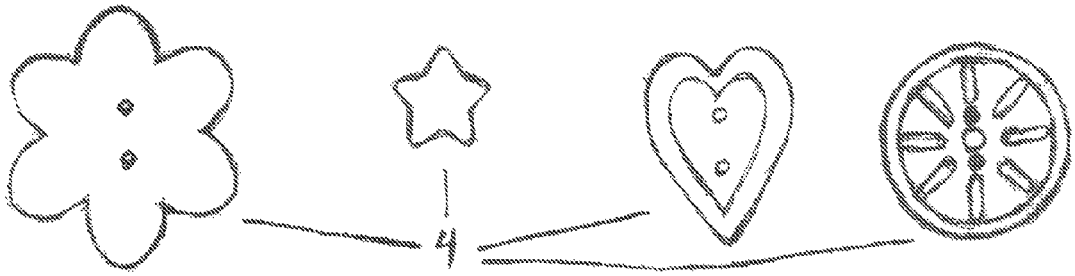
FIG. 10 is front elevational view of a variety of elements that may serve as the ornamental decoration of the body jewelry.
Figure 11:
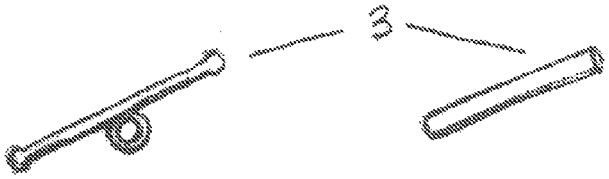
FIG. 11 is a front elevational view of a variety of elements that may serve as the securement element of the body jewelry.

In further detail, referring to FIG. 10 and FIG. 11, the body jewelry may be made with one or more of a variety of ornamental decorations 4, such, as those depicted in FIG. 10. Further, the securement element 3 may be made up of a variety of securement elements, such as those depicted in FIG. 11.

Figure 12:
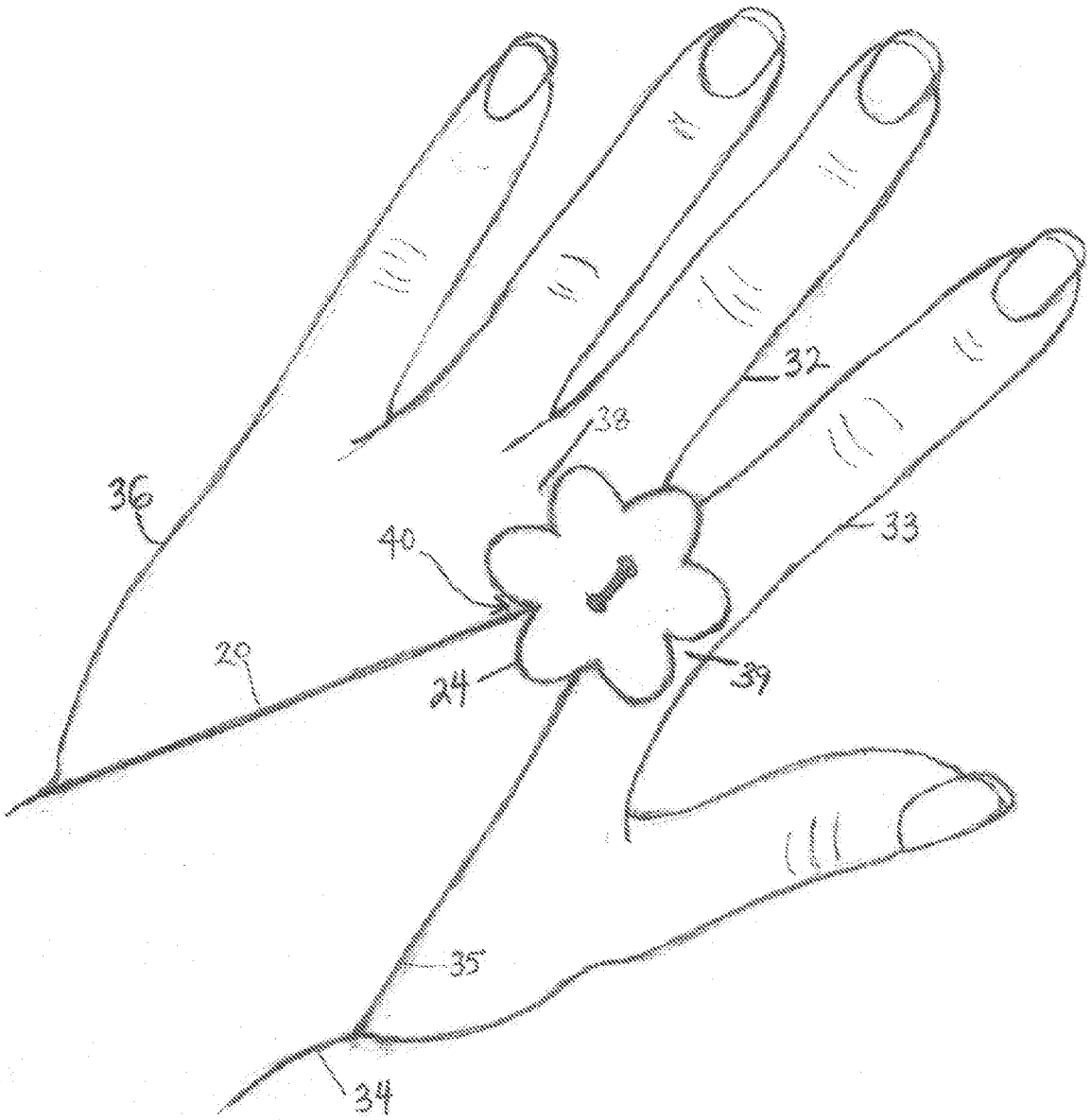
FIG. 12 is a front elevational view of the body jewelry constructed in accordance with one exemplary embodiment of the present invention; and applied in its expanded state to the bare hand of the wearer.
Figure 13:
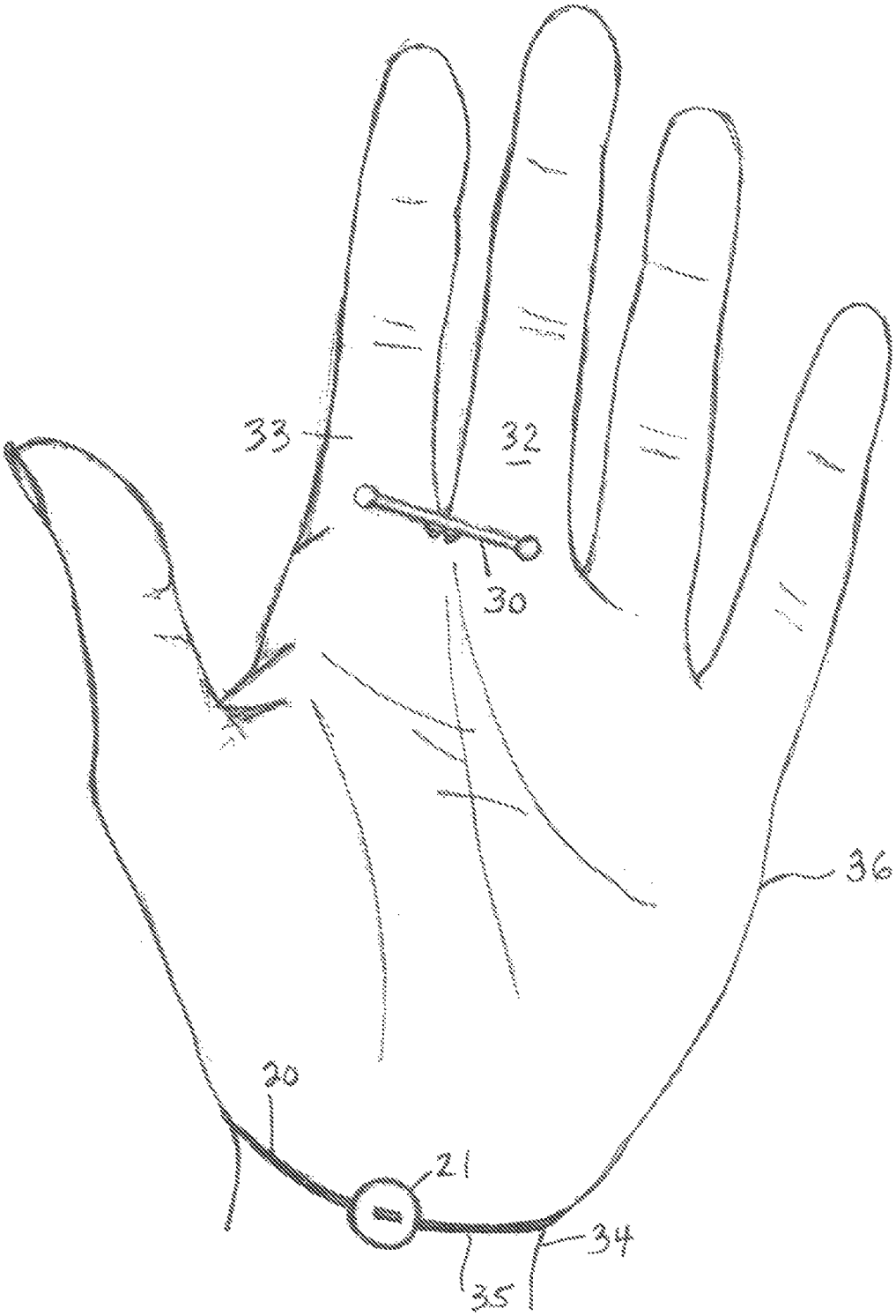
FIG. 13 is a back elevational view of the body jewelry of FIG. 12; as applied in its expanded state to the bare hand of the wearer.
Figure 14:
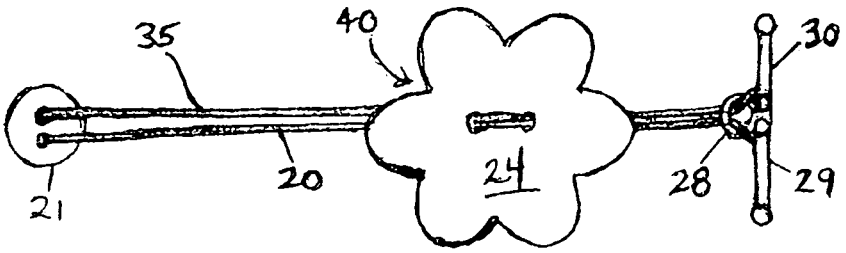
FIG. 14 is a front elevational view of the body jewelry of FIG. 12, the body jewelry shown in an unexpended state when it is not applied to the wearer's hand.
Figure 15:
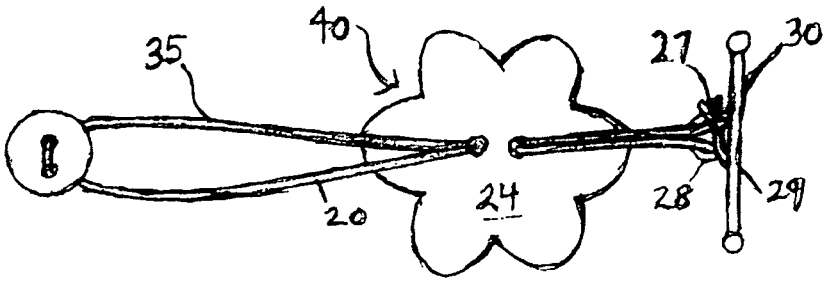
FIG. 15 is a hack elevational view of the body jewelry of FIG. 12, the body jewelry shown in an unexpanded state when it is not applied to the wearer's hand.

Referring now to the invention in FIG. 12 to FIG. 15, when a bar and loop element is used for the securement element 30, as depicted in FIG. 14 and FIG. 15, the body jewelry 40 may be applied to the hand 36 in a similar operation to that described, earlier for FIG. 1 to FIG. 5. See this manner of wearing and using the body jewelry 40, as depicted in FIG. 12 and FIG. 13.

Still referring to the invention of FIG. 12 to FIG. 15, when a bar and loop element is used for the securement element 30, an alternate method of making the body jewelry 40 is used, as described in FIG. 16 to FIG. 19.

Referring to the invention of FIG. 12 to FIG. 15, in operation, in FIG. 12 a section 35 of the elastic material 20 located between an ornamental decoration 24 and decorative element 21 is placed around the wrist 34 of the wearer. In FIG. 13, the ornamental decoration 24 is positioned on the back of the hand 36, e.g., between knuckles 38 and 39, by stretching the securement element 30 and ornamental decoration 24 attached to the elastic material 20 over the back of the hand 36 and placing the securement element 30 behind two adjacent fingers, e.g., fingers 32 and 33 of the hand 36. A section of the elastic material 20 remains secure at the bank of the wrist 34, the ornamental decoration 24 attached to elastic material 20 remains secure over the knuckles 38 and 39, and the securement element 30 attached to elastic material 20 remains in place behind fingers 11 and 12.

In further detail, still referring to the invention of FIG. 12 to FIG. 15, the elastic material 20 is sufficiently thick for threading decorative elements, such as about 0.50 mm to 2.0 mm in diameter (thickness). The length of the elastic material 20 must be adjusted to produce enough tension to maintain the ornamental decoration 24 in place, but must remain slack, enough to be comfortable to the wearer, depending on the size of the wearer's hand. This effect should be reached when the length of the body jewelry is between about 3 inches and 6 inches, as depicted in FIG. 14, when the body jewelry 40 is laid flat, and the body jewelry is measured from the top of securement element 30 to decorative element 21.

Still referring to FIG. 12 to FIG. 15, the securement element 30 should, be sufficiently long to stay in place between the two adjacent fingers behind which it is placed, when subjected to tension from the elastic material 20 located behind the wrist 34 and stretched over the back of the hand 36. The securement element 30 must also be thick enough to keep the ornamental decoration 24 in place by withstanding the tension within the elastic material 20 secured, behind the wearer's wrist 34, threaded through the ornamental decoration 24, and secured by the securement element 30. Thus, the securement element 30 should be about 0.75 inches to 1.25 inches long, and between about 1.5 mm and 5 mm thick, depending on the density of the securement element 30 and the size of the wearer's hand 34.

In further detail, still referring to the invention of FIG. 12 to FIG. 15, when the body jewelry 40 is applied to the back of the hand 36, the ornamental decoration 24 is placed between two adjacent knuckles, e.g., left knuckle 38 and right knuckle 39, in front of two adjacent fingers, e.g., fingers 32 and 33. The securement element 30 sits behind fingers 32 and 33. Thus, the ideal dimension of the ornamental decoration 24 is from about 0.30 inches to 2 inches in length across the top surface, and from about one-tenth of an inch to one inch in thickness.

The construction details of the invention as shown in FIG. 12 to FIG. 15 are that the ornamental decoration 24 be made of any series of decorations, including beads, pendants, wooden or plastic shapes, gemstones, crystals, metal, or any other decorative material. In addition, the decorative element(s) 21 can be made of beads, crystals, gemstones, metal, ball beads, bead caps, buttons, or any other decorative material. The elastic material 30 may be made of any variety of materials that are capable of being stretched or expanded, but that resume their former shape when the tension is released. The securement element 30 may be made of metal compressed paper, wood, plastic, or any other material of sufficient strength and length to withstand tension and keep the ornamental decoration 24 on the wearer's hand 36. Further, the components of the body jewelry depicted in FIG. 12 to FIG. 15 can be made of different materials.

Figure 16:
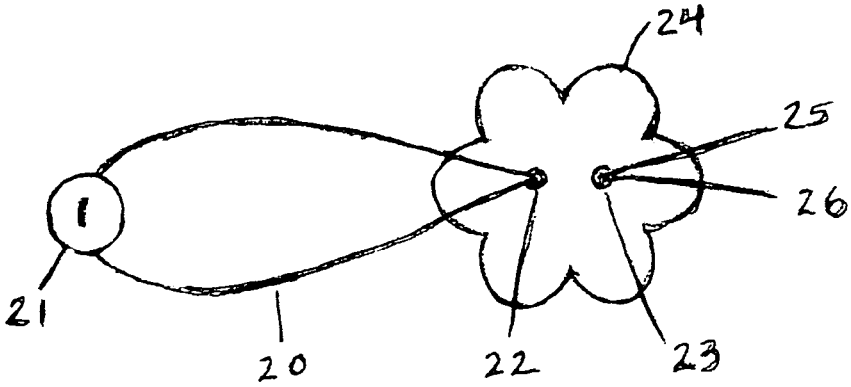
FIG. 16 is a back elevational view of the body jewelry of FIG. 12, the body jewelry shown in an unexpanded state in its first phase of construction.

Referring now to the alternate method of making the invention of FIG. 12 to FIG. 15, see FIG. 16 to FIG. 19. Referring to FIG. 16, one end of a length of elastic material 20 is threaded through decorative element 21, such that decorative element 21 remains on the elastic material 20. Next, two ends 25 and 26 of the elastic material 20 are held, together and threaded through a first hole 22 and then through a second hole 23 of ornamental decoration 24.

Figure 17:
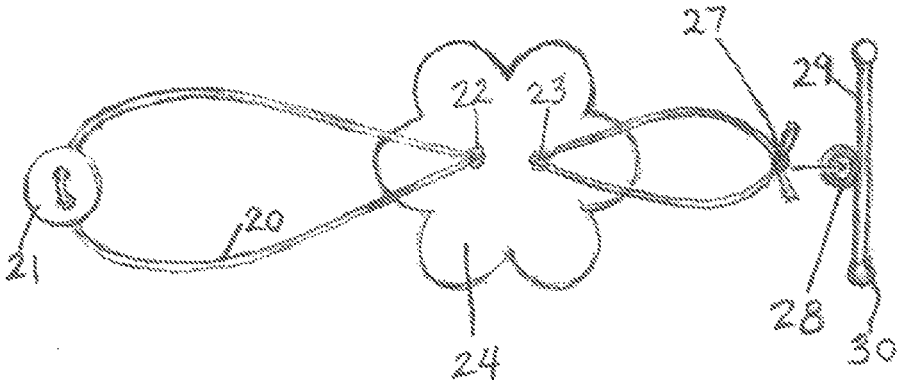
FIG. 17 is a back elevational view of the body jewelry of FIG. 12, the body jewelry shown in an unexpanded state in its second phase of construction.
Figure 18:
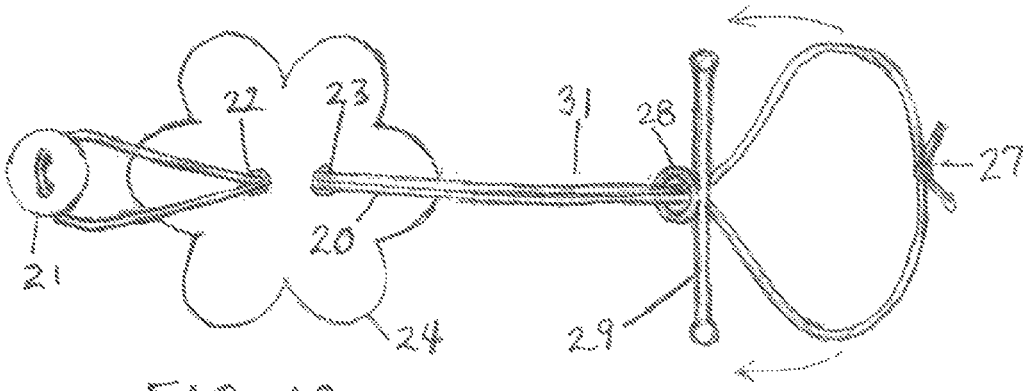
FIG. 18 is a front elevational view of the body jewelry of FIG. 12, the body jewelry shown in an unexpanded state in its third phase of construction.
Figure 19:
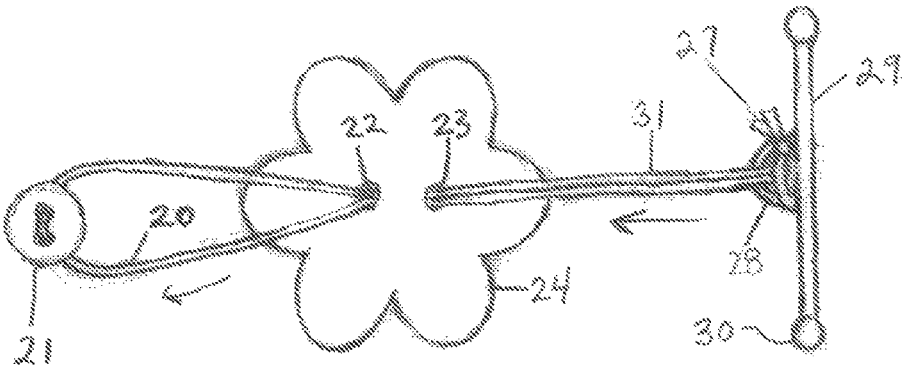
FIG. 19 is a front elevational view of the body jewelry of FIG. 12, the body jewelry shown in an unexpanded state in its completed state of construction.

Still referring to FIG. 16 to FIG. 19, in FIG. 17 two ends 25 and 26 of the elastic material 20 are tied to form a knotted loop 27. The knotted loop 27 is threaded through a hole 28 below a bar 29 on the securement element 30. Referring to FIG. 18, the knotted loop 27 is pulled forward, around the two ends of the bar 29. Referring to FIG. 19, section 31 of the elastic material 20, located to the left of hole 28, is pulled away from the securement element 30. In this manner knotted loop 27 is tightened around the hole 28. Optionally, glue may be added to the knotted loop 27 on the securement element 30 to prevent loosening.

The advantages of the present invention include, without (imitation, the ability of the wearer to attach a body decoration in a non-traditional, innovative manner. The method of wearing the body jewelry allows one to display an ornamental decoration on the body, without the need for a traditional ring, bracelet, wrist or ankle clasp to hold the ornamental decoration in place. The body jewelry does the jewelry does not simply "encircle" or "mold to" a body part. The body jewelry is easy to apply and can be worn for long periods of time in comfort. Even children could apply and remove the jewelry, if they needed to wash their hands, play sports, etc. Moreover, many variations in material design are contemplated, which will attract a wide audience of jewelry wearers.

In abroad embodiment, the present invention is an article of body jewelry comprising elastic material that is placed, around a first location of a body part, stretched over a second location of a body part and secured, behind a third location of a body part. The body jewelry uses the tension within the elastic material stretched, between at least two body part locations to remain in place.

While the foregoing written description of the invention enables one of ordinary skill to make and use what is considered presently to be the best mode thereof those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

I claim:

1. An article of body jewelry, comprising:

a length of elastic material, at least one ornamental decoration, and a securement element;

wherein said length of elastic material is comprised of two ends;

wherein said securement element comprises a bar portion and hole portion;

and wherein said at least one ornamental decoration comprises at least two holes;

and wherein said two ends of said length of elastic material are threaded through said at least two holes on said at least one ornamental decoration, and are then tied to form a knotted loop;

and wherein said knotted loop is threaded through said hole portion of said securement element, pulled around each end of said bar portion, and tightened around said hole portion of said securement element; and wherein said length of elastic material is of a size and elasticity to allow for placement of said article of body jewelry around a wrist of a wearer; stretching of said article over the back of a hand of said wearer; and securing of said article between two adjacent fingers of said hand of said wearer.

2. The article of claim 1, wherein said at least two holes are aligned vertically.

3. The article of claim 1, wherein said at least one ornamental decoration is between 0.30 inches and 2 inches in diameter and between 1/10 of an inch and 1 inch in thickness, in order to remain in place between two knuckles of said hand of said wearer, when said article is placed around the wrist of the wearer, stretched over the back of the hand of the wearer, and secured between the two adjacent fingers of said wearer.

4. The article of claim 1, wherein said securement element is between 0.75 inches and 1.25 inches in length and between 1.5 mm and 5 mm in thickness, and is made of a material of sufficient strength to remain in place when said article is placed around the wrist of the wearer, stretched over the back of the hand of said wearer, and secured between the two adjacent fingers of said wearer.

* * * * *